US006979498B2

(12) United States Patent
Darolia et al.

(10) Patent No.: US 6,979,498 B2
(45) Date of Patent: Dec. 27, 2005

(54) STRENGTHENED BOND COATS FOR THERMAL BARRIER COATINGS

(75) Inventors: Ramgopal Darolia, West Chester, OH (US); Joseph David Rigney, Milford, OH (US); Gillion Herman Marijnissen, Beringe (NL); Eric Richard Irma Carolus Vergeldt, Velden (NL); Annejan Bernard Kloosterman, Meppel (NL)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/721,853

(22) Filed: Nov. 25, 2003

(65) Prior Publication Data

US 2005/0112398 A1 May 26, 2005

(51) Int. Cl.[7] ..... B32B 15/04; F03B 3/12

(52) U.S. Cl. ..... 428/633; 428/323; 428/325; 428/328; 428/336; 428/680; 428/679; 428/670; 428/701; 428/702; 428/698; 428/697; 428/699; 416/241 R

(58) Field of Search ..... 328/621, 632, 328/633, 323, 325, 328, 336, 680, 650, 679, 328/670, 698, 701, 702, 697, 699; 416/241 R

(56) References Cited

U.S. PATENT DOCUMENTS

| | | | |
|---|---|---|---|
| 4,101,713 | A | 7/1978 | Hirsch et al. |
| 4,447,503 | A | 5/1984 | Dardi et al. |
| 4,451,496 | A | 5/1984 | Gedwill et al. |
| 4,916,022 | A | 4/1990 | Solfest et al. |
| 5,015,502 | A | 5/1991 | Strangman et al. |
| 5,254,413 | A | 10/1993 | Mariococchi |
| 5,624,721 | A | 4/1997 | Strangman |
| 5,780,110 | A | 7/1998 | Schaeffer et al. |
| 5,817,371 | A | 10/1998 | Gupta et al. |
| 5,824,423 | A | 10/1998 | Maxwell et al. |
| 5,900,326 | A | 5/1999 | Bornstein et al. |
| 5,975,852 | A | 11/1999 | Nagaraj et al. |
| 6,071,628 | A | 6/2000 | Seals et al. |
| 6,093,454 | A | 7/2000 | Brindley et al. |
| 6,153,313 | A | 11/2000 | Rigney et al. |
| 6,168,874 | B1 | 1/2001 | Gupta et al. |
| 6,255,001 | B1 | 7/2001 | Darolia |
| 6,291,014 | B1 | 9/2001 | Warnes et al. |
| 6,291,084 | B1 | 9/2001 | Darolia et al. |
| 6,306,515 | B1 | 10/2001 | Goedjen et al. |
| 6,376,015 | B1 | 4/2002 | Rickerby |
| 6,455,167 | B1 | 9/2002 | Rigney et al. |
| 6,485,845 | B1 | 11/2002 | Wustman et al. |
| 6,492,038 | B1 | 12/2002 | Rigney et al. |
| 6,514,629 | B1 | 2/2003 | Rigney et al. |

(Continued)

FOREIGN PATENT DOCUMENTS

| | | |
|---|---|---|
| EP | 0340791 A2 | 11/1989 |

(Continued)

*Primary Examiner*—Jennifer McNeil
(74) *Attorney, Agent, or Firm*—Eric W. Guttag; Jagtiani + Guttag; David L. Narciso

(57) ABSTRACT

A strengthened bond coat for improving the adherence of a thermal barrier coating to an underlying metal substrate to resist spallation without degrading oxidation resistance of the bond coat. The bond coat comprises a bond coating material selected from the group consisting of overlay alloy coating materials, aluminide diffusion coating materials and combinations thereof. Particles comprising a substantially insoluble bond coat strengthening compound and having a relatively fine particle size of about 2 microns or less are dispersed within at least the upper portion of the bond coat in an amount sufficient to impart strengthening to the bond coat, and thus limit ratcheting or rumpling thereof.

22 Claims, 1 Drawing Sheet

U.S. PATENT DOCUMENTS

| | | | |
|---|---|---|---|
| 6,544,665 | B2 | 4/2003 | Rigney et al. |
| 6,582,772 | B2 | 6/2003 | Rigney et al. |
| 2002/0004143 | A1 | 1/2002 | Hasz et al. |
| 2003/0017270 | A1 | 1/2003 | Strangman et al. |
| 2003/0118863 | A1 | 6/2003 | Darolia et al. |
| 2003/0134139 | A1 | 7/2003 | Pfaendtner et al. |

FOREIGN PATENT DOCUMENTS

| | | | |
|---|---|---|---|
| EP | 0799904 | A1 | 10/1997 |

STRENGTHENED BOND COATS FOR THERMAL BARRIER COATINGS

BACKGROUND OF THE INVENTION

This invention relates to strengthened bond coats for thermal barrier coatings that protect metal substrates, and in particular to provide improved spallation resistance for such thermal barrier coatings. This invention further relates to articles, in particular turbine engine components, having a metal substrate that use such improved bond coats with such thermal barrier coatings.

The operating environment within a gas turbine engine is both thermally and chemically hostile. Significant advances in high temperature alloys have been achieved through the formulation of iron, nickel and cobalt-base superalloys, though components formed from such alloys often cannot withstand long service exposures if located in certain sections of a gas turbine engine, such as the turbine, combustor and augmentor. A common solution is to provide turbine engine components with an environmental coating that inhibits oxidation and hot corrosion, or a thermal barrier coating (TBC) system that thermally insulates the component surface from its operating environment. TBC systems typically include a ceramic layer adhered to the component with a metallic bond coat that also inhibits oxidation and hot corrosion of the component surface.

Coating materials that have found wide use as TBC bond coats and environmental coatings include overlay alloy coatings such as MCrAlX where M is iron, cobalt and/or nickel and X is hafnium, zirconium, yttrium, tantalum, platinum, palladium, rhenium, silicon or a combination thereof. Also widely used are aluminide diffusion coatings which are formed by a diffusion process, such as pack cementation, above pack, vapor phase, chemical vapor deposition (CVD) or slurry coating processes. The diffusion process results in the coating having two distinct zones or layers, the outermost of which is an additive layer containing an environmentally-resistant intermetallic represented by MAl, where M is nickel, cobalt, and/or iron, depending on the substrate material. Beneath this additive layer is a diffusion zone or layer comprising various intermetallic phases that form during the coating process as a result of diffusional gradients and changes in elemental solubility in the local region of the substrate.

Following deposition, the surface of a bond coat is typically prepared for deposition of the ceramic layer by cleaning and abrasive grit blasting to remove surface contaminants, roughen the bond coat surface, and chemically activate the bond coat surface to promote the adhesion of the ceramic layer. Thereafter, a protective oxide scale is formed on the bond coat at an elevated temperature to further promote adhesion of the ceramic layer. The oxide scale, often referred to as a thermally grown oxide (TGO), primarily develops from selective oxidation of the aluminum and/or MAl constituent of the bond coat, and inhibits further oxidation of the bond coat and underlying substrate. The oxide scale also serves to chemically bond the ceramic layer to the bond coat.

The bond coat used to adhere the thermal barrier coating to the metal substrate can be extremely important to the service life of the thermal barrier coating system that protects the metal substrate. During exposure to the oxidizing conditions within a gas turbine engine, bond coats inherently continue to oxidize over time at elevated temperatures, which gradually depletes aluminum from the bond coat and increases the thickness of the oxide scale. As a result of the thermal expansion mismatch between the bond coat and the oxide scale, as well as the scale growth process and relative mechanical properties at temperature, thermal cycling leads to stresses that cause ratcheting or rumpling of the scale into the bond coat. Eventually, the scale reaches a critical thickness and a high level of rumpling that leads to spallation of the ceramic layer by delamination either at the interface between the bond coat and the oxide scale, or at the interface between the oxide scale and the thermal barrier coating. Once spallation has occurred, the component can deteriorate rapidly, and therefore must be refurbished or scrapped at considerable cost.

Because of the cost associated with refurbishing or scrapping such components, there is a continuous need to improve the spallation resistance of such thermal barrier coatings through improvements in the bond coat. Beneficial results have been achieved by incorporating oxides into the bond coat, as taught by commonly assigned U.S. Pat. No. 5,780,110 (Schaeffer et al), issued Jul. 14, 1998; U.S. Pat. No. 6,168,874 (Gupta et al), issued Jan. 2, 2001; and U.S. Pat. No. 6,485,845 (Wustman et al), issued Nov. 26, 2002. In the Schaeffer et al patent, a submicron dispersion of oxide particles is placed on the surface of the bond coat to inoculate the bond coat oxide. The inoculated bond coat can be preoxidized to form a mature alpha-alumina scale, or a thermal barrier coating can be immediately deposited, during which the inoculated bond coat forms the desired mature alpha-alumina scale. However, inoculating the bond coat surface prevents or at least limits the type of surface preparation that the bond coat can undergo prior to deposition of the thermal barrier coating. For example, bond coat surface cleaning and roughening by grit blasting and electropolishing are precluded by the presence of the oxide particles at the bond coat surface.

In the Gupta et al patent, this complication of the Shaeffer et al method is avoided by codepositing the diffusion bond coat and oxide particles. However, codepositing according to the Gupta et al method cannot readily control the types and morphology of oxides incorporated into the bond coat.

In the Wustman et al patent, the oxide particles are preferentially entrapped in the bond coat by depositing the oxide particles on the surface of the component prior to forming the bond coat. The deposition of the bond coat causes the oxide particles to thus become dispersed in the outer surface region thereof. Wustman et al indicates that suitable oxide particle sizes for dispersion can be less than about 45 microns, although smaller or larger particles could also be used. The improved spallation resistance of the Wustman et al system is attributed to: (1) limiting the diffusion of elements from the metal substrate to the bond coat/thermal barrier coating interface, thus limiting the potential for these elements to form oxides that are detrimental to adhesion of the ceramic layer; (2) creating a tortuous path for crack propagation along the bond coat/thermal barrier coating interface, and therefore acting to limit crack propagation along this interface; (3) providing preferred sites for improving the anchoring of the ceramic layer, and/or that local modification of the bond coat surface and/or chemistry to provide for an improved bond between the ceramic layer and the bond coat; or (4) a combination of these explanations.

In the Wustman et al system, the large particles present can potentially allow relatively high surface areas to be exposed to the oxidizing atmosphere, thus causing rapid internal oxidation, and subsequently poor oxidation resistance. Control of the particle distribution can be difficult or potentially impossible using the Wustman et al system.

There is also the potential inability to create a distribution of extremely fine (i.e., nanometer to micron size) particles in the Wustman et al system.

Bond coat strengthening to limit rumpling and subsequent spallation is usually achieved by addition of oxidatively reactive elements. See commonly-assigned U.S. Pat. No. 5,975,852 (Nargaraj et al), issued Nov. 2, 1999, (NiAl overlay bond coat to which is optionally added one or more reactive elements such as yttrium, cerium, zirconium or hafnium) and U.S. Pat. No. 6,291,084 (Darolia et al), issued Sep. 18, 2001 (predominantly beta-phase NiAl overlay bond coating with limited additions of zirconium and chromium). However, oxidatively reactive elements are difficult to incorporate and control in diffusion coatings. The level of oxidatively reactive elements required for strengthening can also be potentially high enough to degrade the oxidation resistance of the bond coat. Dispersion strengthening of the bond coat, be it an overlay coating such as MCrAlY and especially a diffusion coating with components that do not actively participate in the oxidation process could potentially increase the overall performance of the bond coat.

Accordingly, it is still desirable to be able to further improve the spallation resistance of the thermal barrier coating through modifications of the bond coat. In particular, it would be desirable to modify the bond coat to enable strengthening thereof to limit bond coat ratcheting or rumpling and subsequent thermal barrier coating spallation, as well as to improve overall oxidation resistance through these strengthening improvements. It would be further desirable to be able to strengthen the bond coat by using components that do not actively participate in the oxidation process, especially where the bond coat is a diffusion coating.

BRIEF DESCRIPTION OF THE INVENTION

An embodiment of this invention relates to an improved bond coat for adhering a thermal barrier coating to an underlying metal substrate. This bond coat has an upper portion and comprises:

(1) a bond coating material selected from the group consisting of aluminide diffusion coating materials, overlay alloy coating materials other than a beta-phase NiAl intermetallic overlay coating material, and combinations thereof; and (2) a dispersion within at least the upper portion of the bond coat of particles having a particle size of about 2 microns or less and comprising a substantially insoluble bond coat strengthening compound, the amount of dispersed particles within the at least upper portion of the bond coat being sufficient to impart increased strengthening to the bond coat.

Another embodiment of this invention relates to a coated thermally protected article. This article comprises:

a. a metal substrate;

b. a bond coat layer as previously described adjacent to and overlaying the metal substrate; and c. a thermal barrier coating layer adjacent to and overlaying the bond coat layer.

The embodiments this invention provide several benefits. The inclusion of relatively fine dispersed particles (i.e., up to about 2 microns) of a substantially insoluble bond coat strengthening compound can strengthen the bond coat so as to limit bond coat ratcheting or rumpling and thus prevent subsequent thermal barrier coating spallation. The dispersion of these relatively fine particles particularly especially allows for increased strengthening of bond coats comprising aluminide diffusion coating materials, or combinations thereof with overlay coating materials. The dispersed relatively fine particles can also be formed from bond coat strengthening compounds that are a substantially oxidatively non-reactive so that the oxidation resistance of the strengthened bond coat, especially strengthened bond coats formed from aluminide diffusion coating materials, is also not degraded.

DETAILED DESCRIPTION OF THE INVENTION

Figure 1:
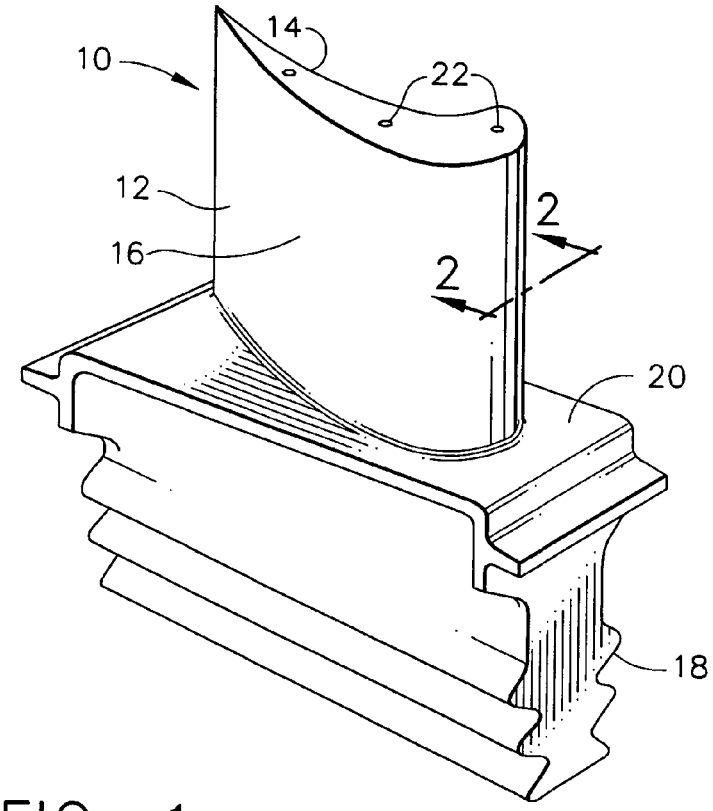
FIG. 1 is a perspective view of a turbine blade.

As used herein, the term "thermal barrier coating" refers to those coatings that are capable of reducing heat flow to the underlying metal substrate of the article, i.e., form a thermal barrier and usually having a melting point of at least about 2000° F. (1093° C.), typically at least about 2200° F. (1204° C.), and more typically in the range of from about 2200° to about 3500° F. (from about 12040 to about 1927° C.). Suitable thermal barrier coatings for use herein can comprise a variety of ceramic materials, including aluminum oxide (alumina), i.e., those compounds and compositions comprising $Al_2O_3$, including unhydrated and hydrated forms, various zirconias, in particular chemically phase-stabilized zirconias (i.e., various metal oxides such as yttrium oxides blended with zirconia), such as yttria-stabilized zirconias, ceria-stabilized zirconias, calcia-stabilized zirconias, scandia-stabilized zirconias, magnesia-stabilized zirconias, ytterbia-stabilized zirconias as well as mixtures of such stabilized zirconias. See, for example, Kirk-Othmer's Encyclopedia of Chemical Technology, 3rd Ed., Vol. 24, pp. 882–883 (1984) for a description of suitable zirconias. Suitable yttria-stabilized zirconias can comprise from about 1 to about 20% yttria (based on the combined weight of yttria and zirconia), and more typically from about 3 to about 10% yttria. These chemically stabilized zirconias can further include one or more of a second metal (e.g., a lanthanide or actinide) oxide such as lanthana, dysprosia, erbia, europia, gadolinia, neodymia, praseodymia, and hafnia to further reduce thermal conductivity of the thermal barrier coating. See U.S. Pat. No. 6,025,078 (Rickerby et al), issued Feb. 15, 2000 and U.S. Pat. No. 6,333,118 (Alperine et al), issued Dec. 21, 2001, both of which are incorporated by reference. Suitable ceramic materials also include pyrochlores of general formula $A_2B_2O_7$ where A is a metal having a valence of 3+ or 2+ (e.g., gadolinium, aluminum, cerium, lanthanum or yttrium) and B is a metal having a valence of 4+ or 5+ (e.g., hafnium, titanium, cerium or zirconium) where the sum of the A and B valences is 7. Representative materials of this type include gadolinium-zirconate, lanthanum titanate, lanthanum zirconate, yttrium zirconate, lanthanum hafnate, cerium zirconate, aluminum cerate, cerium hafnate, aluminum hafnate and lanthanum cerate. See U.S. Pat. No. 6,117,560. (Maloney), issued Sep. 12, 2000; U.S. Pat. No. 6,177,200 (Maloney), issued Jan. 23, 2001; U.S. Pat. No. 6,284,323 (Maloney), issued Sep. 4, 2001; U.S. Pat. No. 6,319,614 (Beele), issued Nov. 20, 2001; and U.S. Pat. No. 6,387,526 (Beele), issued May 14, 2002, all of which are incorporated by reference.

As used herein, the term "aluminide diffusion coating materials" refers to coating materials containing various noble metal aluminides such as nickel aluminide and platinum aluminide, as well as simple aluminides (i.e., those formed without noble metals), and typically formed on metal substrates by chemical vapor phase deposition (CYD), pack cementation or similar or related techniques. Typically, the aluminide diffusion materials used in the bond coats of this invention are platinum aluminides and simple aluminides.

As used herein, the term "overlay alloy coating materials" refers to those materials, and typically other than a beta-phase NiAl intermetallic overlay coating material, that contain various metal alloys such as MCrAlX wherein M is iron, cobalt, nickel, or alloys thereof and wherein X is hafnium, zirconium, yttrium, tantalum, platinum, palladium, rhenium, silicon or a combination thereof. Suitable overlay alloy coating materials can also include MAlX alloys (i.e., without chromium), wherein M and X are defined as before. See U.S. Pat. No. 5,824,423 (Maxwell et al), issued Oct. 20, 1998, which is incorporated by reference. Typically, the overlay alloy coating materials used in the bond coats of this invention are MCrAlY alloys, where M is nickel or a nickel-cobalt alloy.

As used herein, the term "substantially insoluble" refers to a compound that is minimally soluble or completely insoluble in the overlay coating materials and/or aluminide diffusion coating materials that comprise the bond coat up to the expected use temperature (e.g., the temperature of normal operation of a gas turbine engine), and typically up to at least about 2372° F. (1300° C.).

As used herein, the term "substantially oxidatively non-reactive" refers to a compound that is minimally reactive or essentially inert with respect to oxidative reactions, e.g., with atmospheric oxygen or other sources of oxygen, that the bond coat is exposed or subjected to, up to the expected use temperature (e.g., the temperature of normal operation of a gas turbine engine), and typically up to at least about 2372° F. (1300° C.).

As used herein, the term "comprising" means various compositions, compounds, components, layers, steps and the like can be conjointly employed in the present invention. Accordingly, the term "comprising" encompasses the more restrictive terms "consisting essentially of" and "consisting of."

All amounts, parts, ratios and percentages used herein are by weight unless otherwise specified.

The embodiments of the improved bond coating of this invention are useful in protective coatings for metal substrates comprising a variety of metals and metal alloys, including superalloys, used in a wide variety of turbine engine (e.g., gas turbine engine) parts and components operated at, or exposed to, high temperatures, especially higher temperatures that occur during normal engine operation. These turbine engine parts and components can include turbine airfoils such as blades and vanes, turbine shrouds, turbine nozzles, combustor components such as liners, deflectors and their respective dome assemblies, augmentor hardware of gas turbine engines and the like. The embodiments of the improved bond coating of this invention are particularly useful in protective coatings for turbine blades and vanes, and especially the airfoil portions of such blades and vanes. However, while the following discussion of embodiments of the improved bond coatings of this invention will be with reference to turbine blades and vanes, and especially the respective airfoil portion thereof, that comprise these blades and vanes, it should also be understood that the improved bond coatings of this invention can be useful for other articles comprising metal substrates that require protective coatings.

The various embodiments of the improved bond coating of this invention are further illustrated by reference to the drawings as described hereafter. Referring to the drawings, FIG. 1 depicts a component article of a gas turbine engine such as a turbine blade or turbine vane, and in particular a turbine blade identified generally as 10. (Turbine vanes have a similar appearance with respect to the pertinent portions.) Blade 10 can be formed of any operable material, for example, a nickel-base superalloy, which is the base metal of the turbine blade 10. Blade 10 generally includes an airfoil 12 against which hot combustion gases are directed during operation of the gas turbine engine, and whose surfaces are therefore subjected to severe attack by oxidation, corrosion and erosion. Airfoil 12 has a "high-pressure side" indicated as 14 that is concavely shaped; and a suction side indicated as 16 that is convexly shaped and is sometimes known as the "low-pressure side" or "back side." In operation the hot combustion gas is directed against the high-pressure side 14. Blade 10 is anchored to a turbine disk (not shown) with a dovetail 18 formed on the root section 20 of blade 10. Cooling holes 22 are present in airfoil 12 through which bleed air is forced to transfer heat from blade 10.

Figure 2:
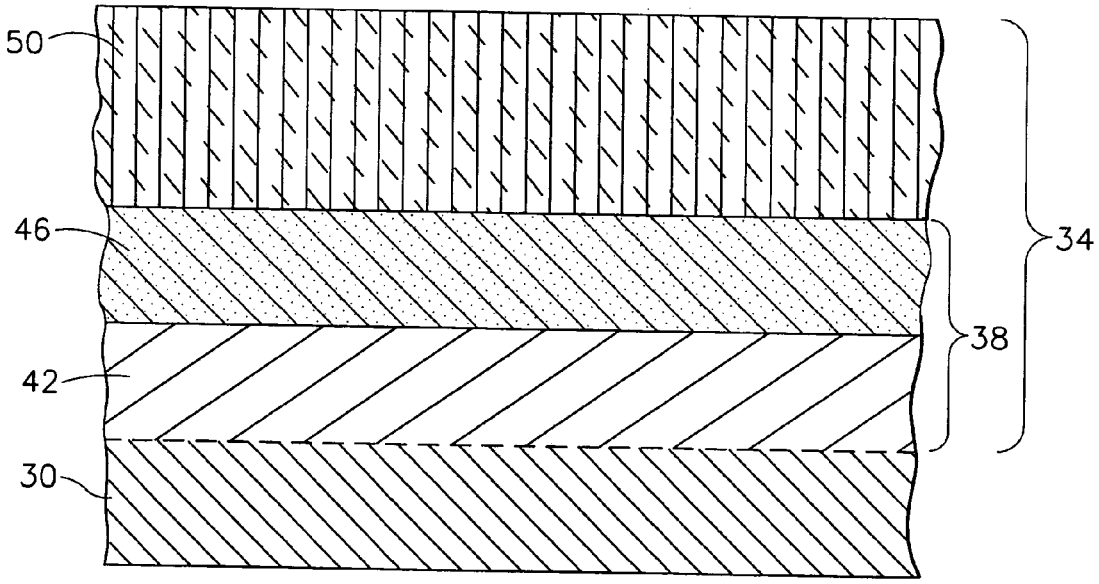
FIG. 2 is an enlarged schematic sectional view through the airfoil portion of the turbine blade of FIG. 1, taken along line 2—2.

Referring to FIG. 2, the base metal of blade 10 serves as a metal substrate that is indicated generally as 30. Substrate 30 can comprise any of a variety of metals, or more typically metal alloys. For example, substrate 30 can comprise a high temperature, heat-resistant alloy, e.g., a superalloy. Such high temperature alloys are disclosed in various references, such as U.S. Pat. No. 5,399,313 (Ross et al), issued Mar. 21, 1995 and U.S. Pat. No. 4,116,723 (Gell et al), issued Sep. 26, 1978, both of which are incorporated by reference. High temperature alloys are also generally described in Kirk-Othmer's Encyclopedia of Chemical Technology, 3rd Ed., Vol. 12, pp. 417–479 (1980), and Vol. 15, pp. 787–800 (1981). Illustrative high temperature nickel-base alloys are designated by the trade names Inconel®, Nimonic®, René® ((e.g., René® (80-, René® (N5 alloys), and Udimet®.

Protective coatings of this invention are particularly useful with nickel-base superalloys. As used herein, "nickel-base" means that the composition has more nickel present than any other element. The nickel-base superalloys are typically of a composition that is strengthened by the precipitation of the gamma-prime phase. More typically, the nickel-base alloy has a composition of from about 4 to about 20% cobalt, from about 1 to about 10% chromium, from about 5 to about 7% aluminum, from 0 to about 2% molybdenum, from about 3 to about 8% tungsten, from about 4 to about 12% tantalum, from 0 to about 2% titanium, from 0 to about 8% rhenium, from 0 to about 6% ruthenium, from 0 to about 1% niobium, from 0 to about 0.1% carbon, from 0 to about 0.01% boron, from 0 to about 0.1% yttrium, from 0 to about 1.5% hafnium, the balance being nickel and incidental impurities.

Protective coatings of this invention are particularly useful with nickel-base alloy compositions such as René N5, which has a nominal composition of about 7.5% cobalt, about 7% chromium, about 6.2% aluminum, about 6.5% tantalum, about 5% tungsten, about 1.5% molybdenum, about 3% rhenium, about 0.05% carbon, about 0.004% boron, about 0.15% hafnium, up to about 0.01% yttrium, balance nickel and incidental impurities. Other operable nickel-base superalloys include, for example, René N6, which has a nominal composition of about 12.5% cobalt, about 4.2% chromium about 1.4% molybdenum, about 5.75% tungsten, about 5.4% rhenium, about 7.2% tantalum, about 5.75% aluminum, about. 0.15% hafnium, about 0.05% carbon, about 0.004% boron, about 0.01% yttrium, balance nickel and incidental impurities; René 142, which has a nominal composition of about 6.8% chromium, about 12.0% cobalt, about 1.5% molybdenum, about 2.8% rhenium, about 1.5% hafnium, about 6.15% aluminum, about 4.9% tungsten, about 6.35% tantalum, about 150 parts per million boron. about 0.12% carbon, balance nickel and incidental impurities; CMSX-4, which has a nominal composition of about 9.60% cobalt, about 6.6% chromium, about 0.60% molybdenum, about 6.4% tungsten, about 3.0% rhenium, about 6.5% tantalum, about 5.6% aluminum, about 1.0% titanium, about 0.10% hafnium, balance nickel and incidental impurities; CMSX-10, which has a nominal composition of about 7.00% cobalt, about 2.65% chromium, about 0.60% molybdenum, about 6.40% tungsten, about 5.50% rhenium, about 7.5% tantalum, about 5.80% aluminum, about 0.80% titanium, about 0.06% hafnium, about 0.4% niobium, balance nickel and incidental impurities; PWA1480, which has a nominal composition of about 5.00% cobalt, about 10.0% chromium, about 4.00% tungsten, about 12.0% tantalum, about 5.00% aluminum, about 1.5% titanium, balance nickel and incidental impurities; PWA1484, which has a nominal composition of about 10.00% cobalt, about 5.00% chromium, about 2.00% molybdenum, about 6.00% tungsten, about 3.00% rhenium, about 8.70% tantalum, about 5.60% aluminum, about 0.10% hafnium, balance nickel and incidental impurities; and MX-4, which has a nominal composition as set forth in U.S. Pat. No. 5,482,789 of from about 0.4 to about 6.5% ruthenium, from about 4.5 to about 5.75% rhenium, from about 5.8 to about 10.7% tantalum, from about 4.25 to about 17.0% cobalt, from 0 to about 0.05% hafnium, from 0 to about 0.06% carbon, from 0 to about 0.01% boron, from 0 to about 0.02% yttrium, from about 0.9 to about 2.0% molybdenum, from about 1.25 to about 6.0% chromium, from 0 to about 1.0% niobium, from about 5.0 to about 6.6% aluminum, from 0 to about 1.0% titanium, from about 3.0 to about 7.5% tungsten, and wherein the sum of molybdenum plus chromium plus niobium is from about 2.15 to about 9.0%, and wherein the sum of aluminum plus titanium plus tungsten is from about 8.0 to about 15.1%, balance nickel and incidental impurities. The use of the present invention is not limited to turbine components made of these preferred alloys, and has broader applicability.

As shown in FIG. 2, adjacent to and overlaying substrate 30 is a protective coating indicated generally as 34. This protective coating 34 comprises a bond coat layer indicated generally as 38 that is adjacent to substrate 30. Bond coat layer 38 is shown in FIG. 2 as having a lower portion 42 directly adjacent to substrate 30 and an upper portion 46 that is directly adjacent to lower portion 42. This bond coat layer 38 can comprise overlay alloy coating materials, aluminide diffusion coating materials or a combination thereof. Bond coat layers 38 comprising overlay alloy coating materials typically have a thickness of from about 0.5 to about 10 mils (from about 12.5 to about 254 microns), more typically from about 4 to about 8 mils (from about 102 to about 203 microns). When bond coat layer 38 comprises aluminide diffusion coating materials, lower portion 42 generally corresponds to an inner diffusion layer (typically from about 30 to about 60% of the thickness of layer 38, more typically from about 40 to about 50% of the thickness of coating layer 38), while upper portion 46 generally corresponds to an outer additive layer (typically from about 40 to about 70% of the thickness of coating layer 38, more typically from about 50 to about 60% of the thickness of coating layer 38). Bond coat layers 38 comprising aluminide diffusion coating materials typically have a thickness of from about 0.5 to about 4 mils (from about 12.5 to about 102 microns), more typically from about 1.5 to about 3 mils (from about 38 to about 76 microns).

To provide improved strengthening for protective coating 34 so that the thermal barrier coating adhered to the bond coat layer 38 is more resistant to spallation, at least the upper portion/additive layer 46 has dispersed therein relatively fine particles comprising a substantially insoluble bond coat strengthening compound, i.e., strengthening of bond coat layer 38 is achieved by a dispersion strengthening mechanism. As long as these fine particles are present in the upper portion/additive layer 46, they can be dispersed substantially uniformly throughout the thickness of bond coat layer 38, as gradients in the bond coat layer 38 having, for example, from low to high levels in the direction towards the upper portion/additive layer 46, or in distinct regions of the bond coat layer 38.

Suitable substantially insoluble bond coat strengthening compounds for use herein include those selected from the group consisting of metal oxides, metal nitrides, metal carbides, and mixtures thereof. Suitable substantially insoluble metal oxides, metal nitrides, and metal carbides for use herein include zirconia ($ZrO_2$), hafnia ($HfO_2$), chromia ($Cr_2O_3$), yttria ($Y_2O_3$), ceria ($CeO_2$), alumina ($Al_2O_3$), lanthana ($La_2O_3$), zirconium carbide (ZrC), hafnium carbide (HfC), tantalum carbide (TaC), and aluminum nitride (AlN), zirconium nitride ($Zr_3N_4$), hafnium nitride ($Hf_3N_4$), and mixtures thereof. The bond coat strengthening compound is typically a substantially oxidatively non-reactive compound such as a metal nitride, or more typically a metal oxide.

These dispersed fine particles comprising the bond coat strengthening compound have a particle size of about 2 microns or less, and are typically in the particle size range of from about 1 to about 2000 nanometers, more typically from about 10 to about 500 nanometers. These dispersed fine particles are also present within at least the upper portion/additive layer 46 in an amount sufficient to impart bond coat strengthening to bond coat layer 38. Such bond coat strengthening is usually achieved when the amount of dispersed particles within at least the upper portion/additive layer 46 is sufficient to provide a volume percent of such particles of at least about 0.1. Typically, the volume percent of dispersed particles is within the range of from about 0.1 to about 5, more typically from about 0.5 to about 2.

This bond coat layer 38 can be applied, deposited or otherwise formed on substrate 30 by any of a variety of conventional techniques well known to those skilled in the art in forming bond coats. In the case of overlay bond coating materials, bond coat layer 38 is typically deposited on substrate 30 by physical vapor deposition (PVD), such as electron beam physical vapor deposition (EB-PVD) techniques, or can alternatively be deposited by thermal spray techniques, such air plasma spray (APS) and vacuum plasma spray (VPS) techniques. Bond coat layers 38 formed from overlay bond coating materials are typically substantially uniform in composition, i.e., there is no discrete or distinct upper portion 46 or lower portion 42. The relatively fine particles comprising the substantially insoluble bond coat strengthening compound(s) can be incorporated into bond coat layer 38 formed from overlay coating materials by, for example: (1) reactive evaporation by introducing a controlled amount (partial pressure) of reactive gases such as oxygen or nitrogen, as well as reactive metallic species, such as aluminum, hafnium, zirconium, etc.; (2) co-evaporation of the particles from a separate stream or pool of ingot comprising strengthening compound(s), for example, by EB-PVD techniques or by co-spraying in a thermal (e.g., air plasma) spray process; (3) spraying overlay coating materials (e.g., powders) that have the strengthening particles incorporated therein, such as by reaction in an atomization chamber when the strengthening particles are formed or using ball or attritor milling to embed the strengthening particles; and (4) forming a mixture or blend coarse and fine coating powders and then spraying the blended powders with process gases that react with the smaller particles as they are heated or propelled towards the substrate 30 to form the strengthening particles. If desired and by appropriate modification of the overlay bond coating process, the concentration of relatively fine particles can be varied in the bond coat layer 38 and particularly to have a higher concentration at or towards the surface of bond coat layer 38 in the upper portion 46 (versus substrate 30).

In the case of aluminide diffusion coating materials, bond coat layer 38 is typically formed on substrate 30 by chemical vapor deposition (CVD), pack cementation and vapor phase aluminiding. Bond coat layers 38 formed from aluminide diffusion coating materials typically have a discrete or distinct lower portion 42 (i.e., diffusion layer) and upper portion 46 (i.e., additive layer). The relatively fine particles comprising the substantially insoluble bond coat strengthening compound(s) can be incorporated into bond coat layer 38 formed from aluminide diffusion coating materials by, for example: (1) organometallic compound decomposition (MOCVD) that is carry out simultaneously with the diffusion coating process during deposition of the upper, additive layer 46; or (2) reactive evaporation by introducing a controlled amount (partial pressure) of reactive gases such as oxygen or nitrogen, as well as the reactive metallic species, such as aluminum, hafnium, zirconium, etc.

As shown in FIG. 2, adjacent and overlaying bond coat layer 38 is a thermal barrier coating (TBC) indicated generally as 50. The thickness of TBC 50 is typically in the range of from about 1 to about 100 mils (from about 25 to about 2540 microns) and will depend upon a variety of factors, including the article that is involved. For example, for turbine blades and vanes, TBC 50 is typically thinner and is usually in the range of from about 3 to about 10 mils (from about 76 to about 254 microns), more typically from about 5 to about 6 mils (from about 127 to about 152 microns). By contrast, in the case of turbine shrouds, TBC 50 is typically thicker and is usually in the range of from about 10 to about 50 mils (from about 254 to about 1270 microns), more typically from about 15 to about 30 mils (from about 381 to about 762 microns).

TBC layer 50 can be applied, deposited or otherwise formed on bond coat layer 38 by any of a variety of conventional techniques, such as physical vapor deposition (PVD), including electron beam physical vapor deposition (EB-PVD), plasma spray, including air plasma spray (APS) and vacuum plasma spray (VPS), or other thermal spray deposition methods such as high velocity oxy-fuel (HVOF) spray, detonation, or wire spray; chemical vapor deposition (CVD), or combinations of plasma spray and CVD techniques. The particular technique used for applying, depositing or otherwise forming TBC 50 will typically depend on the composition of TBC 50, its thickness and especially the physical structure desired for TBC. For example, PVD techniques tend to be useful in forming TBCs having a strain-tolerant columnar structure. By contrast, plasma spray techniques (e.g., APS) tend to create a sponge-like porous structure of open pores.

Various types of PVD and especially EB-PVD techniques well known to those skilled in the art can also be utilized to form TBCs 50 from the ceramic compositions of this invention. See, for example, U.S. Pat. No. 5,645,893 (Rickerby et al), issued Jul. 8, 1997 (especially col. 3, lines 36–63) and U.S. Pat. No. 5,716,720 (Murphy), issued Feb. 10, 1998) (especially col. 5, lines 24–61) and U.S. Pat. No. 6,447,854 (Rigney et al), issued Sep. 10, 2002, which are incorporated by reference. Suitable EB-PVD techniques for use herein typically involve a coating chamber with a gas (or gas mixture) that preferably includes oxygen and an inert gas, though an oxygen-free coating atmosphere can also be employed. The ceramic thermal barrier coating materials are then evaporated with electron beams focused on, for example, ingots of the ceramic thermal barrier coating materials so as to produce a vapor of metal ions, oxygen ions and one or more metal oxides. The metal and oxygen ions and metal oxides recombine to form TBC 50 on the surface of bond coat layer 38.

Various types of plasma-spray techniques well known to those skilled in the art can also be utilized to form TBCs 50 from the ceramic compositions of this invention. See, for example, Kirk-Othmer Encyclopedia of Chemical Technology, 3rd Ed., Vol. 15, page 255, and references noted therein, as well as U.S. Pat. No. 5,332,598 (Kawasaki et al), issued Jul. 26, 1994; U.S. Pat. No. 5,047,612 (Savkar et al) issued Sep. 10, 1991; and U.S. Pat. No. 4,741,286 (Itoh et al), issued May 3, 1998 (herein incorporated by reference) which are instructive in regard to various aspects of plasma spraying suitable for use herein. In general, typical plasma spray techniques involve the formation of a high-temperature plasma, which produces a thermal plume. The ceramic coating materials, e.g., ceramic powders, are fed into the plume, and the high-velocity plume is directed toward the bond coat layer 18. Various details of such plasma spray coating techniques will be well-known to those skilled in the art, including various relevant steps and process parameters such as cleaning of the surface of bond coat layer 38 prior to deposition; grit blasting to remove oxides and roughen the surface substrate temperatures, plasma spray parameters such as spray distances (gun-to-substrate), selection of the number of spray-passes, powder feed rates, particle velocity, torch power, plasma gas selection, oxidation control to adjust oxide stoichiometry, angle-of-deposition, post-treatment of the applied coating; and the like. Torch power can vary in the range of about 10 kilowatts to about 200 kilowatts, and in preferred embodiments, ranges from about 40 kilowatts to about 60 kilowatts. The velocity of the ceramic coating composition particles flowing into the plasma plume (or plasma "jet") is another parameter which is usually controlled very closely.

Suitable plasma spray systems are described in, for example, U.S. Pat. No. 5,047,612 (Savkar et al) issued Sep. 10, 1991, which is incorporated by reference. Briefly, a typical plasma spray system includes a plasma gun anode which has a nozzle pointed in the direction of the deposit-surface of bond coat layer 38. The plasma gun is often controlled automatically, e.g., by a robotic mechanism, which is capable of moving the gun in various patterns across the surface of bond coat layer 38. The plasma plume extends in an axial direction between the exit of the plasma gun anode and the surface of bond coat layer 38. Some sort of powder injection means is disposed at a predetermined, desired axial location between the anode and the surface of bond coat layer 38. In some embodiments of such systems, the powder injection means is spaced apart in a radial sense from the plasma plume region, and an injector tube for the powder material is situated in a position so that it can direct the powder into the plasma plume at a desired angle. The powder particles, entrained in a carrier gas, are propelled through the injector and into the plasma plume. The particles are then heated in the plasma and propelled toward the bond coat layer 38. The particles melt, impact on the bond coat layer 38, and quickly cool to form TBC 50.

While specific embodiments of the method of the present invention have been described, it will be apparent to those skilled in the art that various modifications thereto can be made without departing from the spirit and scope of the present invention as defined in the appended claims.

What is claimed is:

1. A bond coat for adhering a thermal barrier coating to an underlying metal substrate, the bond coat having an upper portion and which comprises:

(1) a bond coating material selected from the group consisting of aluminide diffusion coating materials, overlay alloy coating materials other than a beta-phase NiAl intermetallic overlay coating material, and combinations thereof, and (2) a dispersion within at least the upper portion of the bond coat of particles having a particle size of about 2 microns or less and comprising a substantially insoluble bond coat strengthening compound, the amount of dispersed particles within the at least upper portion of the bond coat being sufficient to impart increased strengthening to the bond coat, wherein the bond coat strengthening compound is selected from the group consisting of, zirconium carbide, hafnium carbide, tantalum carbide, aluminum nitride, zirconium nitride, hafnium nitride, and mixtures thereof.

2. The bond coat of claim 1 wherein the amount of dispersed particles within the at least upper portion of the bond coat is at least about 0.1 volume percent.

3. The bond coat of claim 2 wherein the volume percent of dispersed particles is from about 0.1 to about 5.

4. The bond coat of claim 3 wherein the volume percent of dispersed particles is from about 0.5 to about 2.

5. The bond coat of claim 3 wherein the particle size is in the range of from about 1 to about 2000 nanometers.

6. The bond coat of claim 5 wherein the particle size is in the range of from about 10 to about 500 nanometers.

7. The bond coat of claim 1 wherein the aluminide diffusion coating material is selected from the group consisting of platinum aluminides and simple aluminides, and wherein overlay alloy coating material is selected from the group consisting of MCrAlX, wherein M is iron, cobalt, nickel, or alloys thereof, and wherein X is hafnium, zirconium, yttrium, tantalum, platinum, palladium, rhenium, silicon or a combination thereof.

8. The bond coat of claim 7 wherein the bond coating material is selected from the group consisting of aluminide diffusion coating materials, and combinations of aluminide diffusion coating materials and overlay coating materials.

9. The bond coat of claim 1 wherein the particles are dispersed throughout the thickness of the bond coat layer.

10. A coated thermally protected article, which comprises:

a. a metal substrate;

b. a bond coat layer adjacent to and overlaying the metal substrate, the bond coat layer having an upper portion and comprising:

(1) a bond coating material selected from the group consisting of aluminide diffusion coating materials, overlay alloy coating materials, and combinations thereof, and (2) a dispersion within at least the upper portion of the bond coat of particles having a particle size of about 2 microns or less and comprising a substantially insoluble bond coat strengthening compound, the amount of dispersed particles within the at least upper portion of the bond coat being sufficient to impart increased strengthening to the bond coat, wherein the bond coat strengthening compound is selected from the group consisting of zirconium carbide, hafnium carbide, tantalum carbide, aluminum nitride, zirconium nitride, hafnium nitride, and mixtures thereof; and c. a thermal barrier coating layer adjacent to and overlaying the bond coat layer.

11. The article of claim 10 wherein the amount of dispersed particles within the at least upper portion of the bond coat layer is at least about 0.1 volume percent.

12. The article of claim 11 wherein the particle size is in the range from about 1 to about 2000 nanometers.

13. The article of claim 12 wherein the particle size is in the range of from about 10 to about 500 nanometers.

14. The article of claim 11 wherein the bond coat layer has a thickness of from about 0.5 to about 10 mils and comprises an overlay alloy coating material selected from the group consisting of MCrAlX wherein M is iron, cobalt, nickel, or alloys thereof and wherein X is hafnium, zirconium, yttrium, tantalum, platinum, palladium, rhenium, silicon or a combination thereof.

15. The article of claim 11 wherein the bond coat layer has a thickness of from about 0.5 to about 4 mils and comprises an aluminide diffusion coating material selected from the group consisting of platinum aluminides and simple aluminides.

16. The article of claim 11 which is a turbine engine component and wherein the thermal barrier coating has a thickness of from about 1 to about 100 mils.

17. The article of claim 16 which is a turbine shroud and wherein the thermal barrier coating layer has a thickness of from about 15 to about 30 mils.

18. The article of claim 16 which is a turbine airfoil and wherein the thermal barrier coating layer has a thickness of from about 3 to about 10 mils.

19. The article of claim 11 wherein the volume percent of dispersed particles is from about 0.1 to about 5.

20. The article of claim 19 wherein the volume percent of dispersed particles is from about 0.5 to about 2.

21. The article of claim 19 wherein the aluminide diffusion coating material is selected from the group consisting of platinum aluminides and simple aluminides and wherein the overlay alloy coating material selected from the group consisting of MCrAlX wherein M is iron, cobalt, nickel, or alloys thereof and wherein X is hafnium, zirconium, yttrium, tantalum, platinum, palladium, rhenium, silicon or a combination thereof.

22. The article of claim 21 wherein the bond coat layer comprises an aluminide diffusion coating material and has a thickness of from about 0.5 to about 4 mils.

* * * * *